US006821466B2

(12) United States Patent
Takagi et al.

(10) Patent No.: US 6,821,466 B2
(45) Date of Patent: Nov. 23, 2004

(54) EXTENSIONS FOR APERTURES IN PANELS

(75) Inventors: Kyozaburo Takagi, Centerville, OH (US); Gordon Dodson, Lewis Center, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 170 days.

(21) Appl. No.: 10/327,723

(22) Filed: Dec. 23, 2002

(65) Prior Publication Data

US 2003/0141624 A1 Jul. 31, 2003

Related U.S. Application Data

(60) Provisional application No. 60/344,835, filed on Dec. 21, 2001.

(51) Int. Cl.[7] ..... E04G 11/00

(52) U.S. Cl. ..... 264/154; 264/31; 264/333; 249/35; 249/129; 249/189

(58) Field of Search ..... 264/31, 154, 333; 249/35, 139, 189, 205; 52/127.3, 742.1, 745.2

(56) References Cited

U.S. PATENT DOCUMENTS 4,659,057 A * 4/1987 Felter ..... 249/97
6,182,416 B1 * 2/2001 Brackin ..... 52/745.09
6,322,045 B1 * 11/2001 Andros ..... 249/188
6,540,201 B1 * 4/2003 Gagnon et al. ..... 249/139
2003/0115816 A1 * 6/2003 Dodson et al. ..... 52/381

* cited by examiner

*Primary Examiner*—James P. Mackey
*Assistant Examiner*—Donald Heckenberg
(74) *Attorney, Agent, or Firm*—Dinsmore & Shohl LLP

(57) ABSTRACT

A panel-forming system including a plurality of bulkheads and one or more extensions. A first group of the bulkheads are used to define the overall dimensions and shape of the panel, while a second group are used to define at least one aperture formed into the panel. The extensions are made up of a bulkhead-engaging portion and a recess portion that extends from the bulkhead-engaging portion. The aperture extensions are configured to allow various-shaped recesses to be formed in the panels adjacent the apertures. In accordance with 37 CFR 1.72(b), the purpose of this abstract is to enable the United States Patent and Trademark Office and the public generally to determine quickly from a cursory inspection the nature and gist of the technical disclosure. The abstract will not be used for interpreting the scope of the claims.

50 Claims, 10 Drawing Sheets

EXTENSIONS FOR APERTURES IN PANELS

CROSS-REFERENCE TO RELATED APPLICATION

This application claims the benefit of U.S. Provisional Application Ser. No. 60/344,835, filed Dec. 21, 2001.

BACKGROUND OF THE INVENTION

The present invention relates generally to supports used for creating cured pre-cast panels and related structures, and more specifically to the configuration of extensions used to create recesses at panel edges and apertures that are used to define windows, doorways and related openings in the panel.

Many residential and commercial construction methods involve the use pre-cast structures. Pre-cast panels, for example, are integral to the tilt-up construction process. In the tilt-up approach, concrete forms are arranged on a flat casting surface in the shape and dimension of the desired tilt-up panel, then filled with concrete. When the concrete cures, the panel and the form are separated and the panel is tilted up into a preferred, typically vertical, orientation, where it can be joined to structural frames or other panels. The present inventors have recognized a need for improvements in pre-cast panel forming systems and in various components of the panel forming systems. The improvements introduced by the present invention have applicability in the tilt-up construction process and in other pre-cast construction processes.

BRIEF SUMMARY OF THE INVENTION

This need is met by the present invention wherein improvements in pre-cast panel forming systems and in various components of the panel forming systems are introduced. In accordance with one aspect of the present invention, a panel-forming system is disclosed. The panel-forming system includes a plurality of bulkheads and at least one aperture extension. The bulkheads and aperture extensions are placed on a panel-forming surface. In the present context, the bulkheads and aperture extensions are placed "on" a panel-forming surface, which is meant to be broadly construed, thus encompassing situations where both direct contact between the panel-forming surface (which may be, for example, a smooth floor) and the bulkheads and aperture extensions, as well as indirect support (where, for example, a release liner may be placed over the panel-forming surface prior to arrangement of the bulkheads or aperture extensions) are contemplated. The bulkheads include a first group and a second group, where the first group is arranged into the shape of the panel to be formed, while the second group is disposed substantially within a shape formed by the first group. In the present context, the term "substantially" is utilized to represent the inherent degree of uncertainty that may be attributed to any quantitative comparison, value, measurement, or other representation. As such, it refers to an arrangement of elements or features that, while in theory would be expected to exhibit exact correspondence or behavior, may, in practice embody something slightly less than exact. The term also represents the degree by which a quantitative representation may vary from a stated reference without resulting in a change in the basic function of the subject matter at issue.

Upon formation of a panel (such as by pouring an uncured panel-forming material, for example, concrete into the dimensions bounded by the two bulkhead groups), the space that is substantially surrounded by the second group defines an aperture in the panel. The aperture extension includes a bulkhead-engaging portion configured to contact the bulkhead; and a recess portion extending laterally from the bulkhead-engaging portion such that upon formation of the panel, a pattern becomes defined therein by surfaces on the aperture extension that are configured to face the panel, the recess portion defining a height dimension and an elongate lateral dimension extending from a proximal end to a distal end, the proximal end disposed closer to the bulkhead-engaging portion than the distal end, the elongate lateral dimension being substantially greater than the height dimension. In the present context, the aspect ratio of the aperture extension is defined as the ratio of the height of the portion of the extension that faces the formed panel to the lateral (horizontal) extension of the portion of the extension that faces the formed panel. Thus, in contrast to conventional panel-forming systems that merely include a chamfer designed to create a bevelled recess near a panel edge that is defined by an aspect ratio of unity or thereabouts, the device of the present invention contemplates myriad recess transition possibilities, including long, gradual recesses and multifaceted recesses, which taken alone or together provide the panel designer with numerous functional and aesthetic options.

Optionally, the recess portion further comprises at least one chamfer disposed at the terminus of at least one of the proximal and distal ends. A base clip disposed along at least a part of the recess portion may also be included. In one configuration, the base clip is integrally formed with the recess portion. Preferably, the recess portion is defined by an aspect ratio of less than 0.5, and more preferably less than 0.2, and even more preferably less than 0.1, such that it is considerably wider than it is tall. In another option, the bulkhead-engaging portion and the recess portion together define a unitary (one-piece) construction, while in another the bulkhead-engaging portion and the recess portion are formed as discrete components. In configurations where the bulkhead-engaging portion and the recess portion are formed as discrete components, at least one end of the bulkhead-engaging portion terminates in a chamfer. In addition, the surface of the recess portion that is configured to face the panel can be multi-faceted to define complementary multifaceted surfaces on the portion of the panel adjacent the recess portion. In yet another option, an extension cap is included to engage the distal end of the recess portion. This extension cap effectively widens the lateral dimension of the aperture extension. The upper surface of the extension cap and the recess panel are preferably made to form a substantially seam-free planar surface, thus resulting in fewer seams on the formed panel. In addition, the extension cap comprises one or more notches that define a line of weakness therein to facilitate removal of at least a portion of the extension cap. These notches provide a convenient breakaway point such that the user can select a predetermined lateral length from which to work. In one form, the notches are spaced substantially equidistant from one another. In addition, the extension cap can include a base clip portion disposed adjacent its distal end. This base clip can be used to secure the aperture extension to the panel-forming surface. The base clip may further include frictional engaging members to attach the extension clip to, among other things, the recess portion of the aperture extension. A notch may be disposed between the base clip and the remainder of the extension cap, and as before, define a line of weakness therein to facilitate removal of the base clip. At least one frictional engagement member may be disposed between the extension cap and the recess portion to effect a secure connection between them. All of the aforementioned frictional engagement members may be made up of a plurality of prismatic members. A seal may be disposed substantially at a distal end of the extension cap. In one form, this seal can create a knife-edge along the panel-forming surface so that gaps between the extension cap and the panel-forming surface are eliminated or minimized. This inhibits the undesirable seepage of uncured panel-forming material (such as concrete, for example) into the underside of the aperture extension.

In another option, the aperture extension includes at least one stiffening rib disposed along the recess portion. As with the extension cap, a base clip may be configured to frictionally engage one or more of the stiffening ribs. This can help secure the recess portion to other structure, such as the panel-forming surface. Also as before, the frictional engagement between the base clip and the stiffening rib may comprise a plurality of prismatic members. These are disposed on coupling surfaces of the clip and the rib. In another option, an intermediate can be used to engage the distal end of the recess portion, where an extension cap similar to that previously discussed can engage the intermediate. This allows even longer extension of the aperture extension. As with the recess portion and the extension cap, a base clip may be included to frictionally engage the intermediate, where prismatic members disposed on coupling surfaces of the clip and the intermediate may be used to establish frictional fit. The base clip can be integrally formed with the recess portion, with at least one end of the intermediate. In the latter case, a notch may be disposed between the base clip and the remainder of the intermediate. As with the previously-described notches, these facilitate quick removal along score lines defined by the notches. The intermediate may assume various shapes (such as a chamfer portion) at one or both of its ends. Similarly, the extension cap may comprise a chamfer portion or similar shape at its terminus.

In yet another option, the aperture is surrounded in its entirety by the second group such that a window or door is defined therebetween. To facilitate angled joining at the aperture corners, some of the aperture extensions are configured as multifaceted recess corner sealing device, each comprising a bulkhead-engaging portion and a recess portion. Each multifaceted recess corner sealing device includes a substantially upstanding face disposed along a longitudinal dimension thereof. The multifaceted recess corner sealing devices are configured to be disposed substantially parallel to one another along at least a portion of the second group of bulkheads, where their substantially upstanding faces are configured to project at least as far in a vertical dimension as the taller of the bulkhead-engaging portion and the recess portion of the aperture extensions discussed in the previous aspects of the invention. Upon arrangement of the two types of aperture extensions against the second group of bulkheads, the earlier-described ones are configured to be disposed substantially parallel to one another and substantially perpendicular to multifaceted recess corner sealing device variants such that an end portion of each of the earlier-described aperture extensions abut the substantially upstanding face of the multifaceted recess corner sealing device such that upon introduction of uncured panel material into the recessed panel forming system, the leakage of the uncured panel material into surfaces of the aperture extension opposite the surfaces configured to face the panel is inhibited. In addition, the second group of bulkheads is configured to define more than one aperture in the panel. In a further option, the plurality of apertures in the panel are substantially aligned along at least one edge with one another. Moreover, the multifaceted recess corner sealing devices extend at least the substantial entirety of the length defined by the apertures, and more preferably, the substantial entirety of the length of the panel being formed. In configurations where the multifaceted recess corner sealing devices do not extend the entire length of the panel, their open ends can be plugged with an optional end cap to prevent uncured panel-forming material from flowing into the device cavities. The multifaceted recess corner sealing devices can arranged in a parallel on opposite sides of a generally rectangular aperture such that the substantially upstanding faces face each other.

According to another aspect of the invention, a panel-forming system is disclosed. The system includes a plurality of bulkheads configured to be placed on a panel-forming surface, and at least one aperture extension. The bulkheads are configured similar to those previously discussed. The aperture extension includes a bulkhead-engaging portion and a multifaceted recess portion, the latter of which extends laterally from the bulkhead-engaging portion such that upon formation of the panel, a pattern becomes defined in the panel by surfaces on the aperture extension that are facing the material placed in the panel-forming system. The multifaceted recess portion includes a height dimension, an elongate lateral dimension extending from a proximal end to a distal end, and a longitudinal dimension mutually orthogonal to both the height and lateral dimensions. Optionally, the multifaceted recess portion includes a substantially upstanding face disposed along a longitudinal dimension thereof such that the multifaceted recess portions can be disposed substantially parallel to one another along at least a portion of the second group of bulkheads. Preferably, the multifaceted recess portions are configured to project at least as far in a vertical dimension as the taller of the bulkhead-engaging portion and the recess portion of the aperture extensions mentioned previously. In yet another option, each facet on the multifaceted recess portion is orthogonal to its immediate neighbor, thereby defining a box-like structure. As with the previously-described aspects of the invention, a notch may be included on at least one surface of the aperture extension, the notch configured to facilitate breakaway removal of a portion of the aperture extension from its remainder. Also as before, the aperture extension may be of unitary construction. In another option, an edge seal may be disposed along the longitudinal dimension of the aperture extension. This seal may be along one or more of the corners formed by the various faceted surfaces, and can be made from a soft, resilient material, such as soft polyvinyl chloride. These seals help prevent leakage.

According to another aspect of the invention, an aperture extension and a multifaceted recess corner sealing device, both for use in a panel-forming system, are disclosed. The aperture extension is configured similar to that of the previously-discussed aspects, including a bulkhead-engaging portion and a recess portion. Similarly, the multifaceted recess corner sealing device is as previously discussed. Moreover, the aperture extension and a multifaceted recess corner sealing device can be used either separately or in conjunction with one another.

According to another aspect of the invention, a method of forming an aperture in a panel for tilt-up construction is disclosed. The method comprises the steps of arranging a plurality of bulkheads on a casting surface to form a mold, configuring an aperture extension to comprise a bulkhead-engaging portion and at least one recess portion extending laterally from the bulkhead-engaging portion, coupling the aperture extension to at least one bulkhead from the second group, and pouring uncured casting material into a mold defined by the bulkheads such that, upon formation of a panel with dimensions bounded by the first group and the second group, an aperture becomes defined in a space substantially surrounded by the second group. The bulkheads comprise a first group and a second group, where the first group is arranged in the shape of a panel to be formed, and the second group arranged such that it is substantially disposed within the shape formed by the first group. A pattern becomes defined in the panel by surfaces on the aperture extension that are configured to face the panel. The recess portion defines a height dimension and an elongate lateral dimension, the latter extending from a proximal end to a distal end, where the proximal end is disposed closer to the bulkhead-engaging portion than the distal end. The lateral dimension is substantially greater than the height dimension. Optionally, the method may include the additional steps of curing the casting material and removing the bulkheads and aperture extension from the panel.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1A:
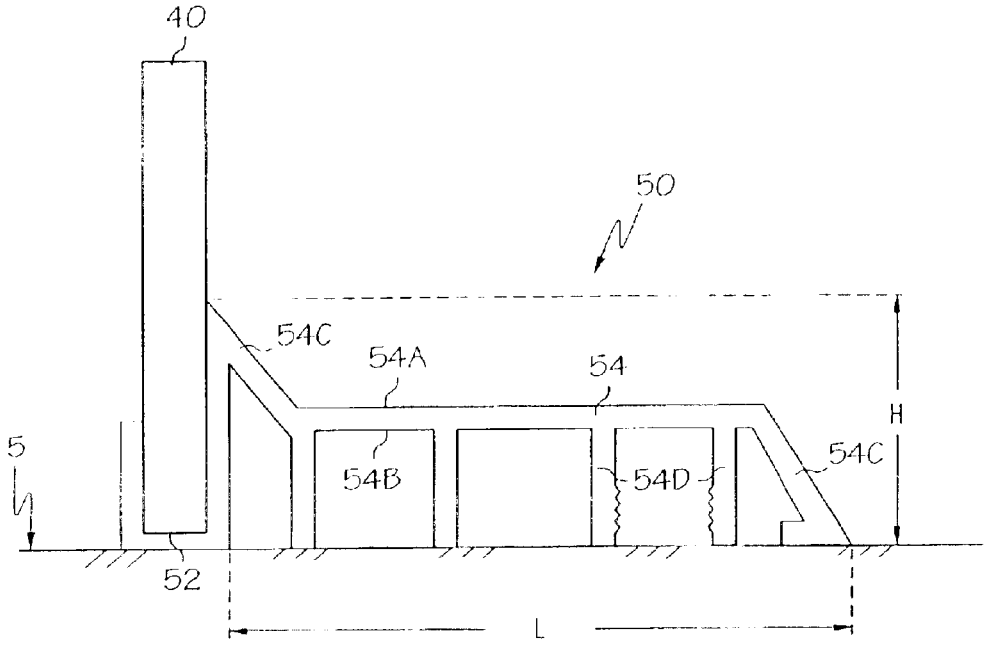
FIG. 1A is an elevation view of an embodiment of the aperture extension of the present invention engaging a bulkhead.
Figure 1B:
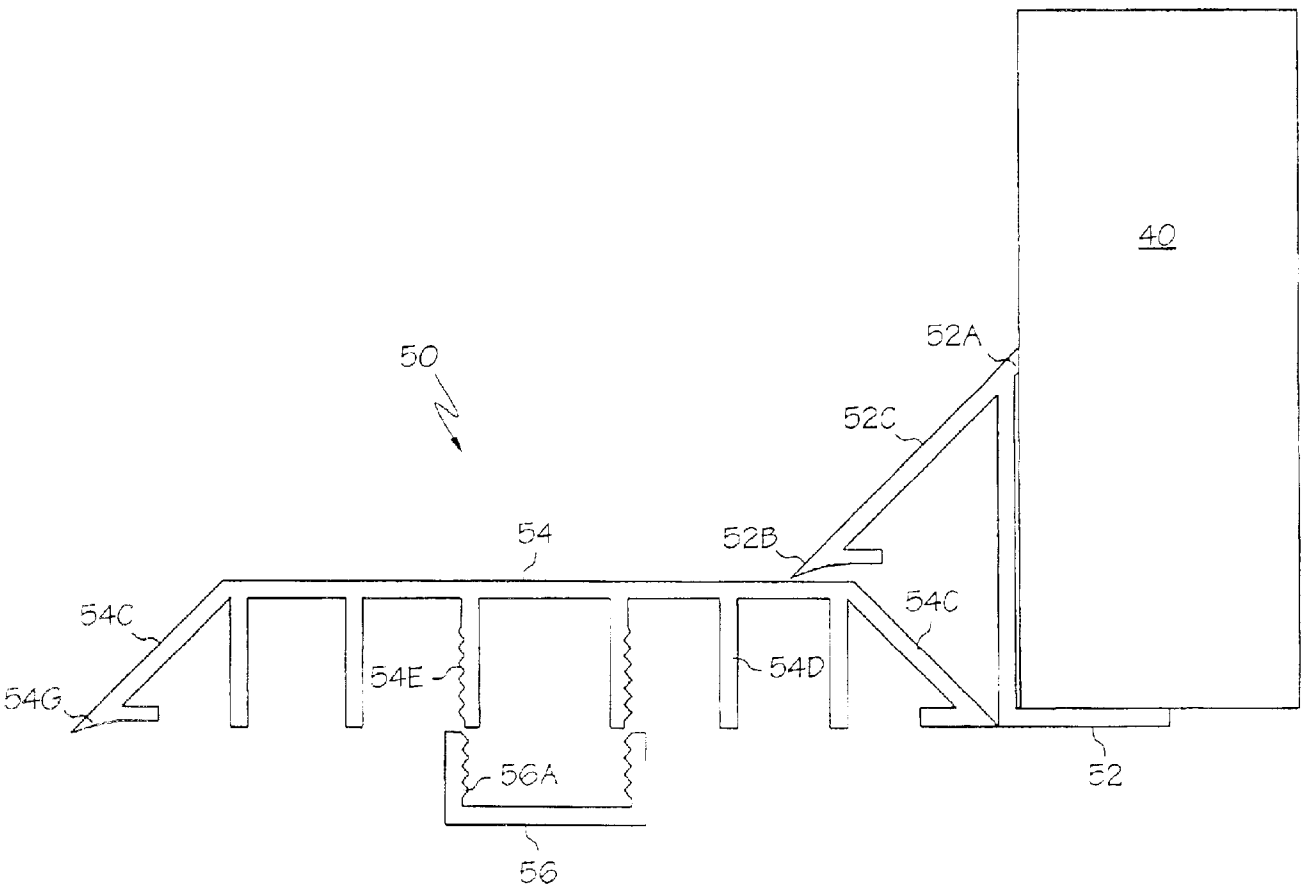
FIG. 1B is an elevation view of an alternate embodiment of the aperture extension of FIG. 1A.
Figure 6:
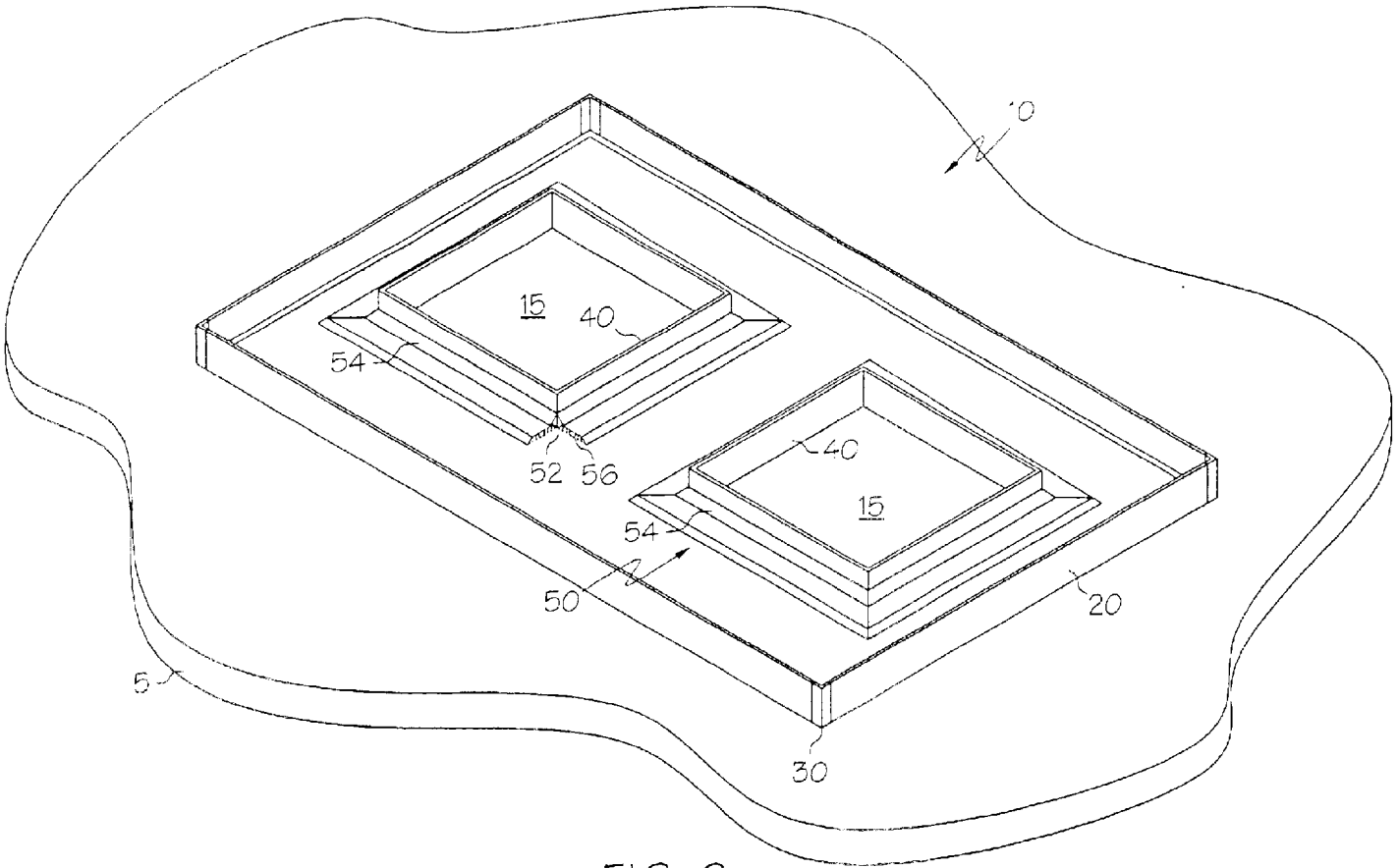
FIG. 6 shows a perspective view of a panel-forming system according to the present invention.

Referring first to FIGS. 1A, 1B and 6, a panel-forming system 10 is placed on top of a panel-forming surface 5, the latter of which is typically a smooth, generally planar surface. The panel-forming system 10 includes a plurality of bulkheads 20 (hereinafter first group bulkheads) that define the outer dimensions of the panel to be formed (not shown), a plurality of connectors 30 that can be used to secure the various first group bulkheads 20 together, and an additional plurality of bulkheads 40 (hereinafter second group bulkheads) that define the outer dimensions of one or more apertures 15 formed in the panel.

In the formation of pre-cast (or tilt-up) panels, it is advantageous to form aperture shapes into the panel prior to forming and subsequent curing of the panel-forming material (such as concrete). These apertures can be entirely enclosed within the peripheral walls of the panel (forming openings for windows or the like), or they can be formed such that one or more dimensions coincide with one or more of the peripheral walls, thus forming a door-like opening. In the former case, aperture 15 is defined entirely by the second group bulkheads 40, while in the latter by a combination of the second group bulkheads 40 (for internally-projecting portions of the aperture) and the first group bulkheads 20 for portions of the aperture that coincide with the panel periphery. In certain circumstances, it would be advantageous to provide extra definition around the periphery of aperture 15 such that the transition from aperture to panel is not so abrupt, thus providing enhanced aesthetics, as well as added resistance to cured material chipping and related breakage. In the present invention, aperture extensions 50 are employed during the panel-forming process to facilitate the formation of gradual, patterned aperture transition zones. The aperture extension 50 is defined by a relatively low aspect ratio, such that the lateral dimension L is larger than the height H. Representative lengths of the lateral dimension L range from eight to twenty inches, although the present invention is not limited to such lengths. The aperture extensions 50 may be made from numerous low-cost materials, including plastic. Moreover, the shapes defining the bulkhead-engaging portion and the recess portion can be made from low-cost manufacturing methods, such as extrusion. By using inexpensive, easy to work with materials, long sections of the aperture extensions 50 may be cut into desired length strips that can be easily assembled on the job site. Variations on aperture extension 50 are shown with particularity in FIGS. 1A and 1B, both including a bulkhead-engaging portion 52 to connect to bulkheads from the second group bulkheads 40. The bulkhead-engaging portion 52 is configured as a generally U-shaped cup into which the lower edge of the bulkhead can rest. The aperture extension 50 also includes a recess portion 54 extending laterally from the bulkhead-engaging portion 52. The recess portion 54 includes a panel-facing surface 54A and a surface 54B opposite the panel, where the shape of the former defines a pattern that gets formed into the panel when the panel-forming material is poured into the mold and subsequently cured. The recess portion 54 also includes chamfers 54C at the proximal and distal ends, such chamfers used to help define the shape of the pattern formed into the panel. As shown with particularity in FIG. 1B, a seal 54G is disposed at the terminus of the chamfer 54C. The surface 54B opposite the panel faces the panel-forming surface, and along with the rest of the space defined underneath aperture extension 50, is configured to be generally free of panel-forming material. The seal 54G forms a knife-edge that splays under the load of panel-forming material, thus inhibiting leakage of panel-forming material into the space formed under the aperture extension 50. Stiffening ribs 54D act as load-bearing structure to minimized deformation of aperture extension 50 under the weight of the panel-forming material. A series of prismatic engagement members 54E are formed in the walls of ribs 54D such that the ribs can frictionally engage complementary surfaces on a base clip 56. The base clip 56 may be formed integral with or separate from the recess portion 54, and can be secured to the panel-forming surface 5 by conventional adhesive or attachment means, including nails, screws or the like.

Referring with particularity to FIG. 1B, the bulkhead-engaging portion 52 and the recess portion 54 are formed from separate, discrete members, in contrast to the one-piece (unitary) construction of FIG. 1A. In this configuration, the base clip 56 is also separate such that the aperture extension is formed by arranging the three components to fit together. In this configuration, the bulkhead-engaging portion 52 has a chamfer 52C at one end such that a portion of the pattern in the panel is formed by the bulkhead-engaging portion 52. Seals 52A and 52B form a knife-edge similar to that of aforementioned seal 54G to reduce leakage at the boundary formed between the aperture extension 50 and the bulkhead 40.

Referring with particularity to FIG. 6, a panel-forming system 10 is configured for a two-aperture 15 panel. Aperture extensions 50 are placed around all four walls that define each aperture 15, thus forming a transition zone between the aperture 15 and the panel, where one corner is shown exposed to better depict the relationship between the bulkhead 40, bulkhead-engaging portion 52, recess portion 54 and base clip 56. The dimensions of the aperture extensions 50 are shown to more clearly present the details herein, and not shown to scale, as for a typical bulkhead 40, which may be four, eight, ten or twelve inches in height when placed edgewise on the panel-forming surface 5, the height of the aperture extension may be on the order of two inches or less. It will, however, be appreciated by those skilled in the art that the representative dimensions discussed herein are not to be construed as limiting, as other sizes are within the scope of the present invention.

Figure 2A:
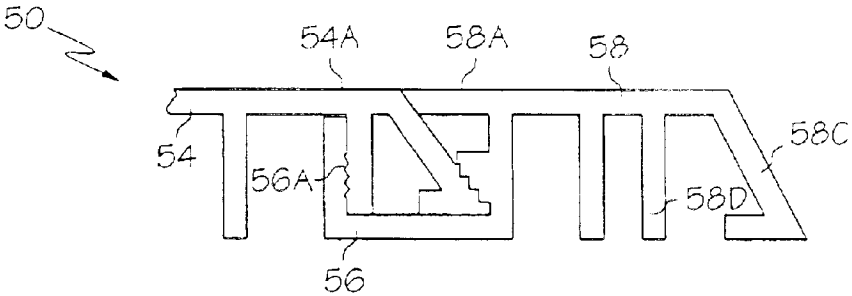
FIG. 2A is a partial view of the aperture extension of FIG. 1A, including an extension cap.
Figure 2B:
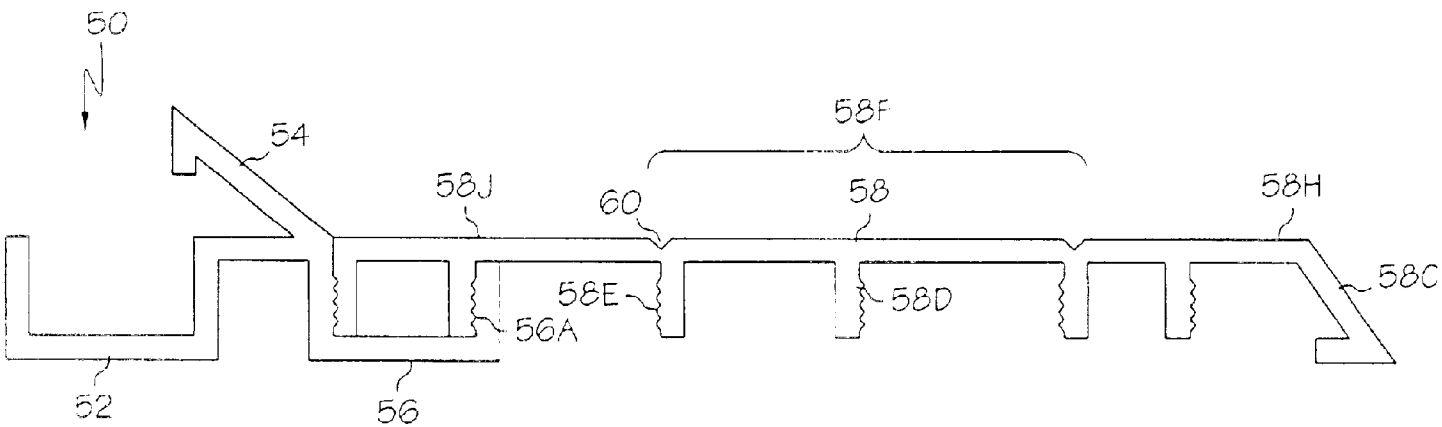
FIG. 2B is a variation of the extension cap of FIG. 2A, showing breakaway portions along one or more notches.
Figure 2C:
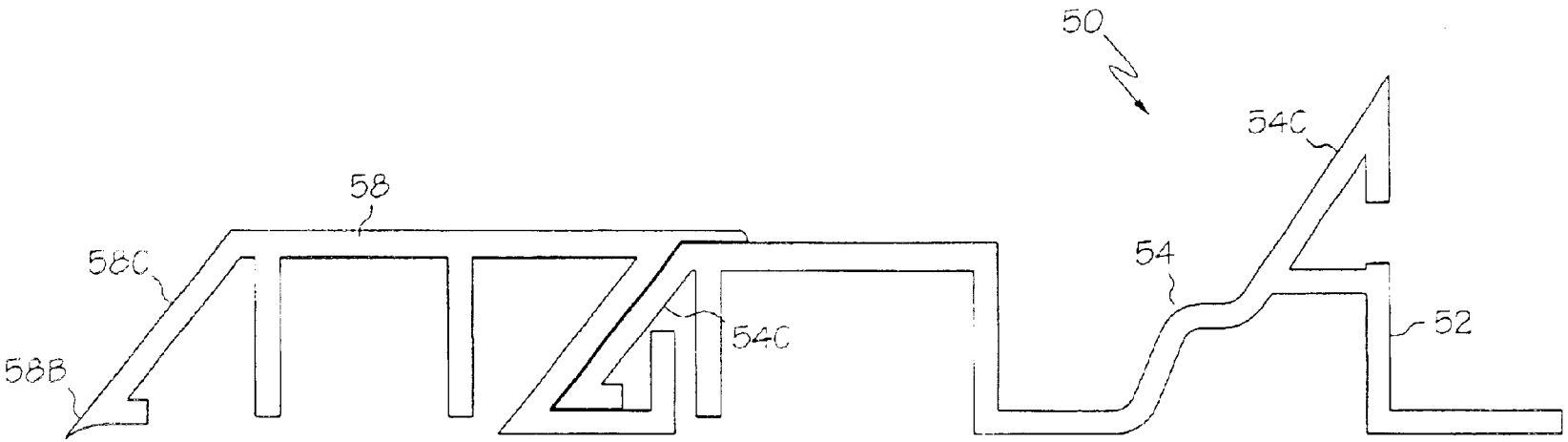
FIG. 2C is a variation of the connection between an aperture extension and an extension cap.
Figure 3A:
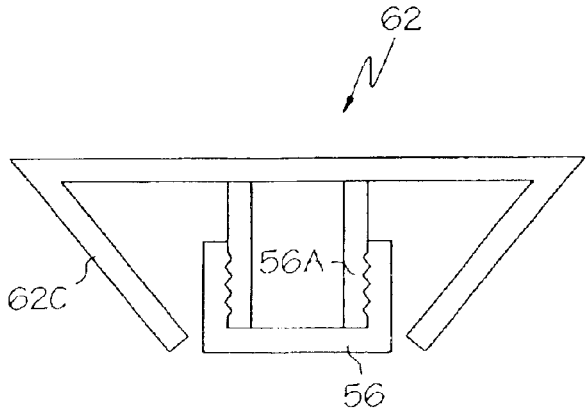
FIG. 3A shows an intermediate.
Figure 3B:
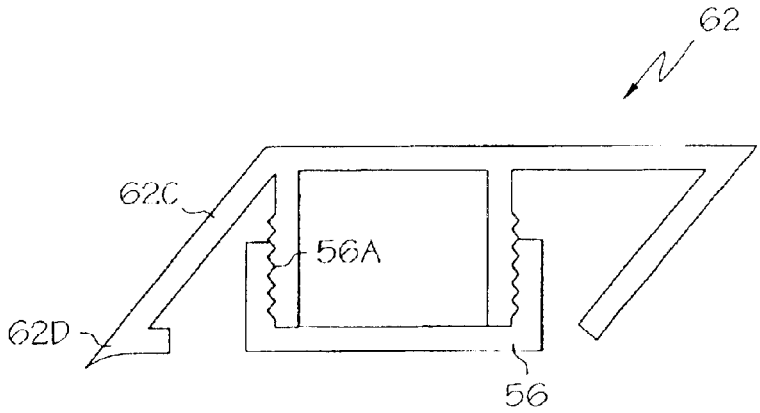
FIG. 3B shows an alternate embodiment of the intermediate.
Figure 3C:
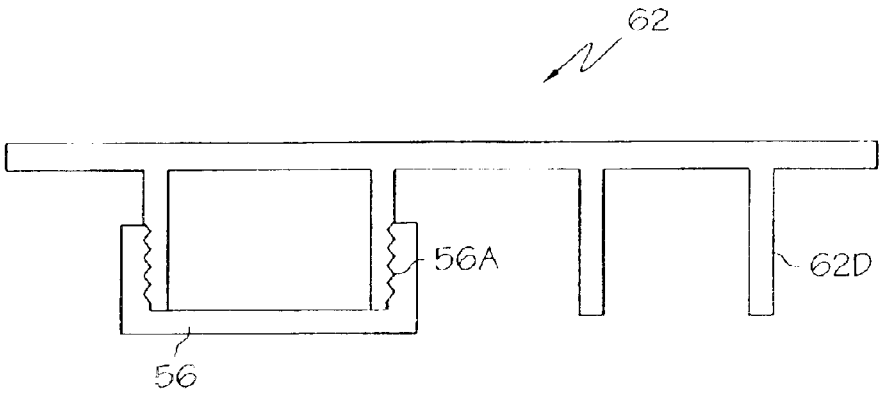
FIG. 3C shows yet an alternate embodiment of the intermediate.
Figure 4:
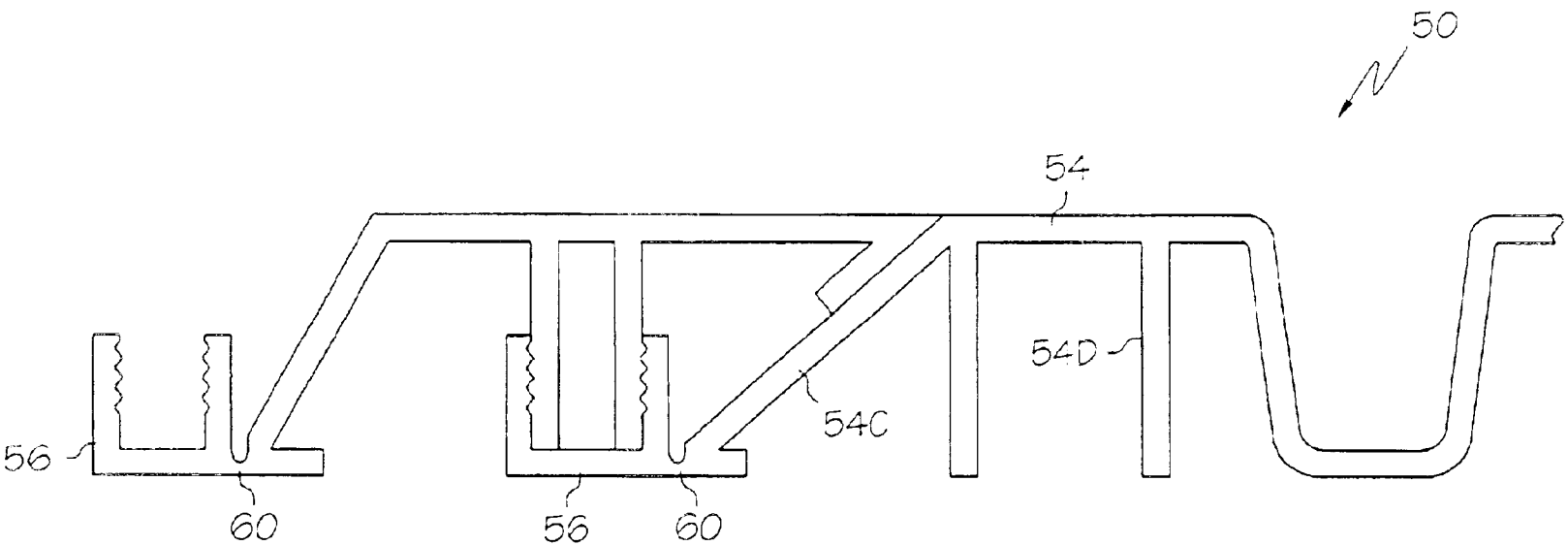
FIG. 4 shows the integration of the intermediate of FIG. 3B into an aperture extension.
Figure 5A:
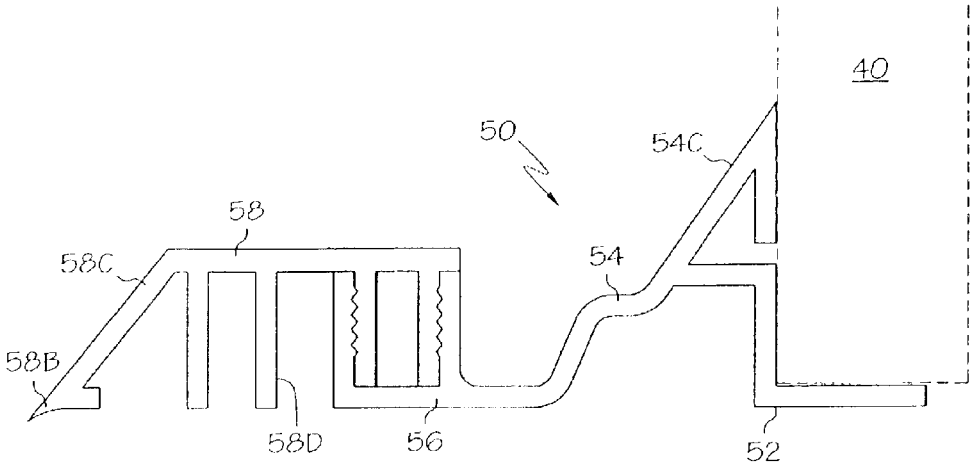
FIG. 5A shows an alternate embodiment of the aperture extension of FIG. 1A with an extension cap coupled to it, both connected by a base clip.
Figure 5B:
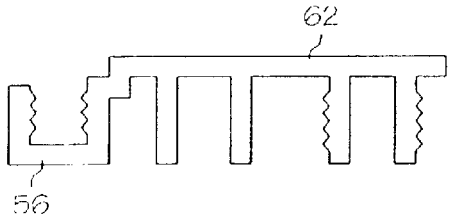
FIG. 5B shows an alternate embodiment of the intermediates of FIGS. 4A–4C.

Referring next to FIGS. 2A through 2C, 3A through 3C, 4, 5A and 5B, additional ways to extend the lateral dimension of the aperture extension 50 are disclosed. From the distal end of aperture extension 50, an extension cap 58 is added. The extension cap 58 includes an upper surface 58A, a chamfer 58C with seal 58B, stiffening ribs 58D and (as shown with particularity on the configuration depicted in FIG. 2A) an integral base clip 56 with frictional engaging members 56A. The configuration shown in FIG. 2A allows the distal end of the aperture extension 50 to lock with extension cap 58 through the base clip 56. The configuration shown in FIG. 2B achieves the same, but further includes notches 60 such that a sacrificial region 58F is defined between them. In this way, the full extension made possible by the extension cap 58 can be exploited, or the extension cap 58 can be broken away at the notches 60 such that once the sacrificial region 58F is removed, the now-free end region 58H can be moved adjacent proximal region 58J and attached to another base clip (not shown). It will be appreciated that the wall thickness of the aperture extension 50 and extension cap 58 are shown exaggerated for clarity, but that the actual dimensions are relatively thin, subject to minimum structural requirements, to keep weight and raw material cost low. Thus, no appreciable gaps are formed between the lower surface of the ribs 58D and the panel-forming surface (not presently shown), thus substantially preserving the desired panel shape along panel-facing surface 54A and upper surface 58A. Referring with particularity to FIG. 2C, a variation on the pattern formed in the panel by the aperture extension 50 is shown, where additional facets on the surface of recess portion 54 are included. An extension cap 58 is also included, where the interlocking connection between it and the aperture extension 50 is defined by complementary surfaces that are slidably engageable with one another along the longitudinal axis of the aperture extension 50, rather than through the toothed prismatic members previously shown. Referring with particularity to FIGS. 3A through 3C, intermediates 62 are shown. These devices are capable of fitting in between the aperture extension 50 and an extension cap 58, or can, if equipped with a chamfer 62D (as shown in FIG. 3B), act as a surrogate for the extension cap 58. Moreover, in situations where multiple apertures are formed into a single panel (such as that shown in FIG. 6), the intermediates 62 can act to bridge aperture extensions 50 or extension caps 58, thereby forming contiguous aperture extensions. As with the aperture extension 50 and the extension cap 58, the intermediate can include a base clip 56, either as a separate member (as shown in FIGS. 3A through 3C), or as an integral (unitary) part, as shown with particularity in FIG. 4. In the latter case, a notch 60 functions in a manner similar to that of the previous notches, allowing the clip to be broken away if not needed. In situations where a further extension is desired from the intermediate, the base clip 56 is left in place to allow an additional member to be attached thereto. The base clip 56 disposed at the distal end of recess portion 54 of aperture extension 50 is also configured to allow easy removal (if desired). As shown in FIG. 4, other pattern configurations along the recess portion 54 are possible. FIGS. 5A and 5B show how both the extension cap 58 and the intermediates 62 can be combined with the aperture extension 50. The intermediate in FIG. 5B shows, in a variation of the configurations of FIGS. 3A through 3C, an integrally-formed base clip 56 that does not have a breakaway feature built in. This can be used in situations where a robust intermediate is required.

Figure 7B:
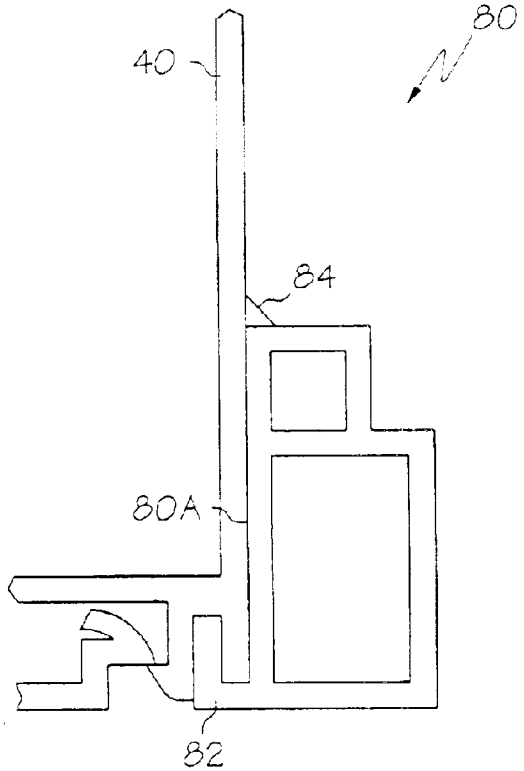
FIG. 7B shows a variation of the aperture extension of FIG. 7A.
Figure 7A:
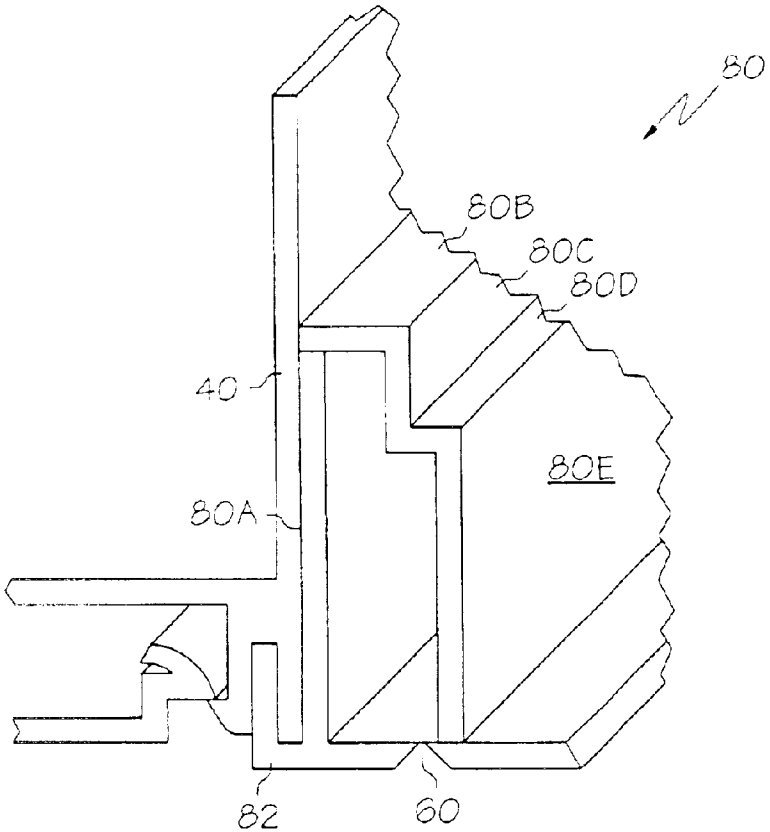
FIG. 7A shows an alternate embodiment of the aperture extension of FIG. 1A.

Referring next to FIGS. 7A and 7B, two variations on a multifaceted recess corner sealing device 80 are shown, where multifaceted recess corner sealing device 80 acts as a specific complement to aperture extension 50. The multifaceted recess corner sealing device 80, rather than emphasizing the low aspect ratio of the aperture extension 50, projects more in the heightwise dimension. The bulkhead-facing side of multifaceted recess corner sealing device 80 is defined by a substantially upstanding face 80A that forms a solid, generally planar surface. Individual faceted surfaces 80B, 80C, 80D and 80E are used to define the pattern formed in the panel upon the pouring and curing of the panel-forming material. Referring with particularity to FIG. 7A, the portion containing the various faceted surfaces can be removed along notches 60. As with the earlier drawings, the dimensions of the multifaceted recess corner sealing device 80 are not necessarily to scale, and while capable of occupying the substantial entirety of the height of the bulkhead 40, are typically relatively short in comparison. In the present figures, the bulkhead 40 is formed from a manufactured part (such as extruded plastic) that can include dimensions tailored to fit in addition to having a bulkhead-engaging portion 82. It will be appreciated by those skilled in the art that the bulkhead 40 can be either a conventional form (such as a piece of lumber) or the aforementioned manufactured part. FIG. 7B highlights the inclusion of an edge seal along the longitudinal dimension of the multifaceted recess corner sealing device 80. This seal, which can be made from a relatively soft, yet resilient, material, helps to prevent leakage of panel-forming material between the bulkhead 40 and the substantially upstanding face 80A.

Figure 8:
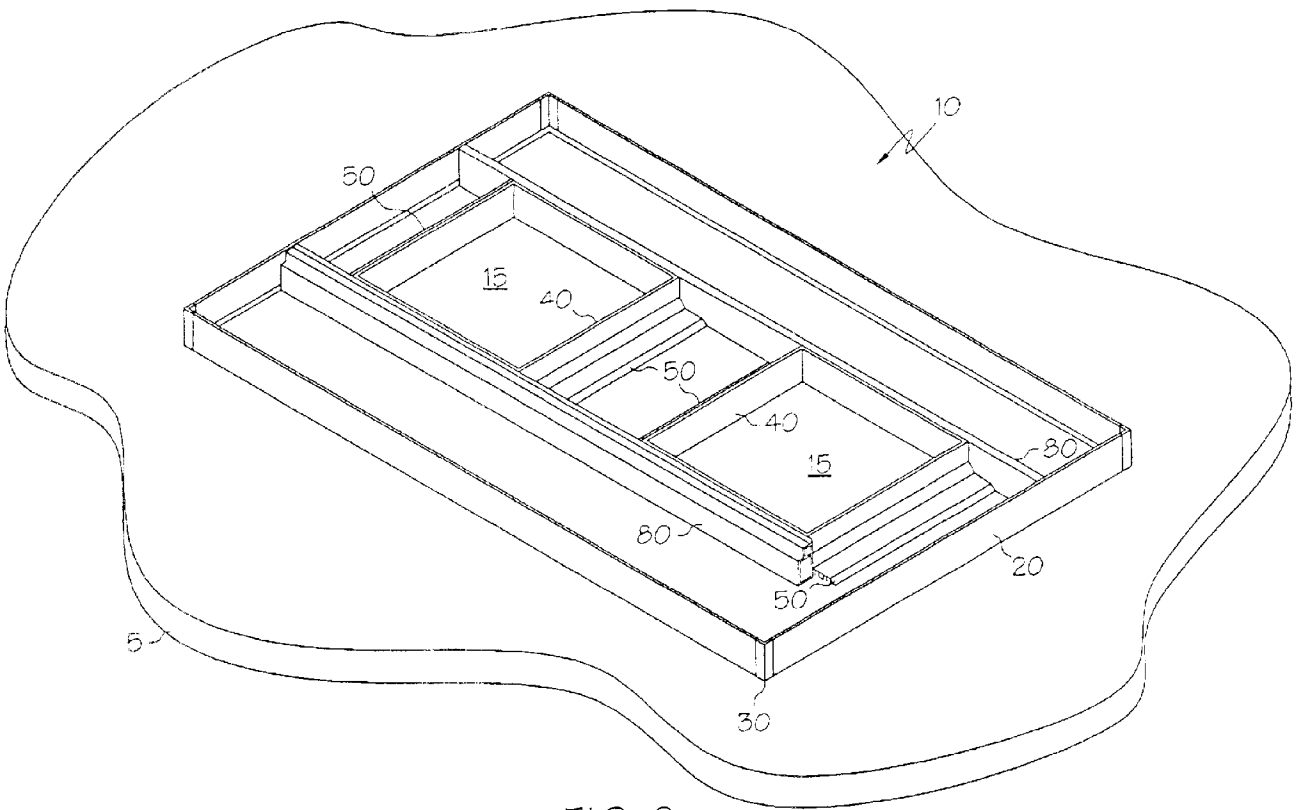
FIG. 8 shows a perspective view of an alternate panel-forming system according to the present invention.

Referring with particularity to FIG. 8, the use of the multifaceted recess corner sealing devices 80 in conjunction with the aperture extensions 50 are shown. Absent the presence of the substantially upstanding face 80A from the multifaceted recess corner sealing device 80, the ends of the aperture extensions 50 would be left exposed, thereby allowing uncured panel-forming material to seep in between the aperture extensions 50 and the panel-forming surface 5. The multifaceted recess corner sealing devices 80, which are shown extending along the entire lengthwise dimension of the panel-forming system 10, act to close of the exposed end of the aperture extensions 50 that extend the width of the aperture 15. As previously mentioned, the multifaceted recess corner sealing devices 80 need not extend all the way to the bulkheads 20 that define the ends of the panel-forming system 10. In such a configuration, end caps (not shown) could be fitted onto the ends of the multifaceted recess corner sealing devices 80 to inhibit the flow of panel-forming material into the device cavities. The figure also shows in the gap between the two aperture extensions 50 disposed between the two apertures 15 where one of the intermediates 62 (specifically, an extended version of the variant shown in FIG. 3A) could fit to form a bridge between the two apertures 15. By having the heightwise dimension of the multifaceted recess corner sealing device 80 be at least as tall as the highest exposed portion of the aperture extension 50, the present system reduces the likelihood that panel-forming material will leak underneath the aperture extension 50. As previously mentioned, the relative height of the aperture extension and the multifaceted recess corner sealing device 80 are shown somewhat enlarged for clarity.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A panel-forming system comprising:

a plurality of bulkheads configured to be placed on a panel-forming surface, said bulkheads comprising a first group and a second group, said first group arranged in the shape of a panel to be formed, said second group configured to be disposed substantially within a shape formed by said first group such that, upon formation of a panel with dimensions bounded by said first group and said second group, an aperture becomes defined in a space substantially surrounded by said second group; and at least one aperture extension comprising:

a bulkhead-engaging portion configured to contact at least one bulkhead of said second bulkhead group and;

a recess portion extending laterally from said bulkhead-engaging portion such that upon formation of said panel, a pattern becomes defined therein by surfaces on said aperture extension that are configured to face said panel, said recess portion defining a height dimension and an elongate lateral dimension extending from a proximal end to a distal end, said proximal end disposed closer to said bulkhead-engaging portion than said distal end, said elongate lateral dimension being substantially greater than said height dimension.

2. A panel-forming system according to claim 1, wherein said recess portion further comprises at least one chamfer disposed at the terminus of at least one of said proximal and distal ends.

3. A panel-forming system according to claim 1, wherein said recess portion further comprises a chamfer disposed at the terminus of both of said proximal and distal ends.

4. A panel-forming system according to claim 1, further comprising a base clip disposed along at least a part of said recess portion.

5. A panel-forming system according to claim 4, wherein said base clip is integrally formed with said recess portion.

6. A panel-forming system according to claim 1, wherein said recess portion is defined by an aspect ratio of less than 0.5.

7. A panel-forming system according to claim 1, wherein said recess portion is defined by an aspect ratio of less than 0.2.

8. A panel-forming system according to claim 1, wherein said recess portion is defined by an aspect ratio of less than 0.1.

9. A panel-forming system according to claim 1, wherein together said bulkhead-engaging portion and said recess portion define a unitary construction.

10. A panel-forming system according to claim 1, wherein together said bulkhead-engaging portion and said recess portion are formed as discrete components.

11. A panel-forming system according to claim 10, wherein at least one end of said bulkhead-engaging portion terminates in a chamfer.

12. A panel-forming system according to claim 1, wherein said surface of said recess portion that is configured to face said panel is multi-faceted.

13. A panel-forming system according to claim 1, further comprising an extension cap configured to engage said distal end of said recess portion.

14. A panel-forming system according to claim 13, wherein an upper surface of said extension cap and an upper surface of said recess panel form a substantially seam-free planar surface with which to engage said panel.

15. A panel-forming system according to claim 13, wherein said extension cap comprises at least one notch defining a line of weakness therein to facilitate removal of at least a portion of said extension cap.

16. A panel-forming system according to claim 15, wherein said at least one notch comprises a plurality of notches.

17. A panel-forming system according to claim 16, wherein a sacrificial part of said extension cap is defined between said plurality of notches.

18. A panel-forming system according to claim 13, wherein said extension cap further comprises a base clip portion disposed adjacent its distal end.

19. A panel-forming system according to claim 18, further comprising at least one notch disposed between said base clip portion and the remainder of said extension cap, said notch defining a line of weakness therein to facilitate removal of said base clip portion.

20. A panel-forming system according to claim 13, further comprising at least one frictional engagement member disposed between said extension cap and said recess portion to effect a secure connection therebetween.

21. A panel-forming system according to claim 20, wherein said at least one frictional engagement member comprises a plurality of prismatic members.

22. A panel-forming system according to claim 1, further comprising a seal disposed substantially at a distal end of said extension cap.

23. A panel-forming system according to claim 1, further comprising at least one stiffening rib disposed along said recess portion.

24. A panel-forming system according to claim 23, further comprising a base clip configured to frictionally engage said at least one stiffening rib.

25. A panel-forming system according to claim 24, wherein said at least one frictional engagement between said base clip and said at least one stiffening rib comprises a plurality of prismatic members disposed on coupling surfaces of said clip and said rib.

26. A panel-forming system according to claim 1, further comprising:

an intermediate configured to engage said distal end of said recess portion; and an extension cap configured to engage said intermediate.

27. A panel-forming system according to claim 26, further comprising a base clip configured to frictionally engage said intermediate.

28. A panel-forming system according to claim 27, wherein said base clip is integrally formed with said recess portion.

29. A panel-forming system according to claim 27, wherein said base clip is integrally formed with at least one end of said intermediate.

30. A panel-forming system according to claim 29, further comprising a notch disposed between said base clip and the remainder of said intermediate.

31. A panel-forming system according to claim 30, wherein said at least one frictional engagement between said intermediate and said base clip comprises a plurality of prismatic members disposed on coupling surfaces of said clip and said intermediate.

32. A panel-forming system according to claim 26, wherein said intermediate further comprises a chamfer portion configured to engage said panel.

33. A panel-forming system according to claim 32, wherein said extension cap further comprises a chamfer portion.

34. A panel-forming system according to claim 1, wherein said aperture is surrounded in its entirety by said second group such that a window is defined therebetween.

35. A panel-forming system according to claim 1, wherein said aperture is surrounded by both said first and second groups such that a door is defined therebetween.

36. A panel-forming system according to claim 1, further comprising a plurality of multifaceted recess corner sealing devices, each comprising a substantially upstanding face disposed along a longitudinal dimension thereof, said multifaceted recess corner sealing devices configured to be disposed substantially parallel to one another along at least a portion of said second group of bulkheads, said multifaceted recess corner sealing devices further configured to project at least as far in a vertical dimension as the taller of said bulkhead-engaging portion and said recess portion of said aperture extension, whereupon arrangement of said aperture extensions and said multifaceted recess corner sealing devices against said second group of bulkheads, said aperture extensions are configured to be disposed substantially parallel to one another and substantially perpendicular to said multifaceted recess corner sealing devices such that an end portion of each of said aperture extension is configured to abut said substantially upstanding face of said multifaceted recess corner sealing device such that upon introduction of uncured panel material into said recessed panel forming system, the leakage of said uncured panel material into surfaces of said aperture extension opposite said surfaces configured to face said panel is inhibited.

37. A panel-forming system according to claim 1, wherein said second group is configured to define a plurality of apertures in said panel.

38. A panel-forming system according to claim 37, wherein said plurality of apertures in said panel are substantially aligned along at least one edge with one another.

39. A panel-forming system according to claim 38, wherein said multifaceted recess corner sealing devices extend the substantial entirety of the length defined by said panel.

40. A panel-forming system according to claim 36, wherein said multifaceted recess corner sealing devices are arranged such that said substantially upstanding faces face each other.

41. A panel-forming system comprising:

a plurality of bulkheads configured to be placed on a panel-forming surface, said bulkheads comprising a first group and a second group, said first group arranged in the shape of a panel to be formed, said second group configured to be disposed substantially within a shape formed by said first group such that, upon formation of a panel with dimensions bounded by said first group and said second group, an aperture becomes defined in a space substantially surrounded by said second group; and at least one aperture extension comprising:

a bulkhead-engaging portion configured to contact at least one bulkhead of said second bulkhead group; and a recess portion extending laterally from said bulkhead-engaging portion such that upon formation of said panel, a pattern becomes defined therein by surfaces on said aperture extension that are configured to face said panel, said recess portion defining a height dimension and an elongate lateral dimension extending from a proximal end to a distal end, said proximal end disposed closer to said bulkhead-engaging portion than said distal end, said elongate lateral dimension being substantially greater than said height dimension; and an extension cap configured to engage said distal end of said recess portion.

42. A panel-forming system comprising:

a plurality of bulkheads configured to be placed on a panel-forming surface, said bulkheads comprising a first group and a second group, said first group arranged in the shape of a panel to be formed, said second group configured to be disposed substantially within a shape formed by said first group such that, upon formation of a panel with dimensions bounded by said first group and said second group, an aperture becomes defined in a space substantially surrounded by said second group; and at least one aperture extension comprising:

a bulkhead-engaging portion configured to contact at least one bulkhead of said second bulkhead group; and a recess portion extending laterally from said bulkhead-engaging portion such that upon formation of said panel, a pattern becomes defined therein by surfaces on said aperture extension that are configured to face said panel, said recess portion defining a height dimension and an elongate lateral dimension extending from a proximal end to a distal end, said proximal end disposed closer to said bulkhead-engaging portion than said distal end, said elongate lateral dimension being substantially greater than said height dimension;

an intermediate configured to engage said distal end of said recess portion; and an extension cap configured to engage said intermediate.

43. A panel-forming system comprising:

a plurality of bulkheads configured to be placed on a panel-forming surface, said bulkheads comprising a first group and a second group, said first group arranged in the shape of a panel to be formed, said second group configured to be disposed substantially within a shape formed by said first group such that, upon formation of a panel with dimensions bounded by said first group and said second group, an aperture becomes defined in a space substantially surrounded by said second group; and at least one aperture extension comprising:

a bulkhead-engaging portion configured to contact at least one bulkhead of said second bulkhead group; and a multifaceted recess portion extending laterally from said bulkhead-engaging portion such that upon formation of said panel, a pattern becomes defined therein by surfaces on said aperture extension that are configured to face said panel, said multifaceted recess portion defining a height dimension, an elongate lateral dimension extending from a proximal end to a distal end, and a longitudinal dimension mutually orthogonal to both said height and lateral dimensions.

44. A panel-forming system according to claim 43, wherein each facet on said multifaceted recess portion is orthogonal to its immediate neighbor.

45. A panel-forming system according to claim 43, further comprising a notch on at least one surface of said aperture extension, said notch configured to facilitate breakaway removal of a portion of said aperture extension from its remainder.

46. A panel-forming system according to claim 43, wherein said aperture extension is of unitary construction.

47. A panel-forming system according to claim 42, further comprising an edge seal along said longitudinal dimension.

48. A method of forming an aperture in a panel, said method comprising:

arranging a plurality of bulkheads on a casting surface to form a mold, said bulkheads comprising a first group and a second group, said first group arranged in the shape of a panel to be formed, said second group arranged such that it is substantially disposed within said shape formed by said first group and defines at least one aperture in a space substantially surrounded by said second group;

configuring an aperture extension to comprise:

a bulkhead-engaging portion configured to contact at least one bulkhead of said second bulkhead group; and at least one recess portion extending laterally from said bulkhead-engaging portion such that upon formation of said panel, a pattern becomes defined therein by surfaces on said aperture extension that are configured to face said panel, said recess portion defining a height dimension and an elongate lateral dimension extending from a proximal end to a distal end, said proximal end disposed closer to said bulkhead-engaging portion than said distal end, said lateral dimension being substantially greater than said height dimension;

coupling said aperture extension to at least one bulkhead from said second group; and pouring uncured casting material into a mold defined by said bulkheads such that, upon formation of a panel with dimensions bounded by said first group and said second group, an aperture becomes defined in a space substantially surrounded by said second group.

49. A method according to claim 48, further comprising the step of curing said casting material.

50. A method according to claim 49, further comprising the step of removing said bulkheads and said aperture extension from said panel.

* * * * *